United States Patent [19]

Gahler et al.

[11] 4,132,923

[45] Jan. 2, 1979

[54] CIRCUIT FOR LIGHT-INTEGRATOR-CONTROLLED ELECTRONIC FLASH UNIT

[75] Inventors: Egon Gahler, Hattersheim; Rolf Dietrich, Hofheim, both of Germany

[73] Assignee: Braun Aktiengesellschaft, Frankfurt am Main, Germany

[21] Appl. No.: 701,984

[22] Filed: Jul. 1, 1976

[51] Int. Cl.[2] ..... H05B 41/32

[52] U.S. Cl. ..... 315/151; 315/159; 315/241 P

[58] Field of Search ..... 315/149, 151, 156, 159, 315/241 P

[56] References Cited

U.S. PATENT DOCUMENTS

| | | | |
|---|---|---|---|
| 3,809,954 | 5/1974 | Engelstatter | 315/241 P |
| 3,878,433 | 4/1975 | Sato | 315/151 X |

FOREIGN PATENT DOCUMENTS

| | | | |
|---|---|---|---|
| 46-26667 | 8/1971 | Japan | 315/241 P |
| 1396685 | 6/1975 | United Kingdom | 315/241 P |

*Primary Examiner*—Eugene R. LaRoche
*Attorney, Agent, or Firm*—Michael J. Striker

[57] ABSTRACT

The flash unit includes a flash element and a first electronic switch connected in the current path of the flash element. The flash element is ignited by rendering the first switch conductive. Flash-terminating circuitry terminates the flash by rendering the first switch non-conductive. The flash-terminating circuit includes a commutation capacitor and a second electronic switch interconnected with each other and with the first switch for applying the commutation capacitor voltage to the first electronic switch as a reverse-bias voltage when the second electronic switch is rendered conductive. The second electronic switch is a two-electrode electronic switch which can be rendered conductive by raising the voltage across its electrodes above the value at which such voltage is normally maintained. A light-integrating device detects the light emitted by the flash element and when such amount has reached a predetermined value renders the second electronic switch conductive by raising the voltage across the electrodes of the second electronic switch.

25 Claims, 6 Drawing Figures

TO FIRING CIRCUIT
101
109
108
102
107
103
105
TO TRIGGER CIRCUIT
104
106
118
110
116
119
114
117
113
111
115
112
TO AUTOMATIC EXPOSURE CONTROL CIRCUIT 201
208
209
202
218
205
212
216
203
204
206
211
215
214
217
219
210
207
213

CIRCUIT FOR LIGHT-INTEGRATOR-CONTROLLED ELECTRONIC FLASH UNIT

BACKGROUND OF THE INVENTION

The invention relates to a circuit expedient intended for use in electronic flash units of the type whose operation is controlled by a light integrator.

Typically the circuitry of such electronic flash units includes a storage capacitor energized by a source of electrical energy, and connected in parallel to the storage capacitor the series combination of a flash tube and a first electronic switch. The first electronic switch serves to initiate and terminate the flow of current through the flash lamp. The first electronic switch has two main electrodes and a control electrode and can be rendered non-conductive by applying a reverse-bias voltage across its two main electrodes. The type of circuit in question usually includes furthermore a second electronic switch. The conductivity of the second electronic switch is controlled by an automatic exposure control device. The latter senses the light reflected back towards the flash unit from the objects being illuminated by the flash unit. The intensity of the sensed reflected light is integrated, and when the total amount of sensed light reaches a certain value, the automatic exposure control device triggers the second electronic switch. When that occurs, the second electronic switch effects the discharge of a commutation capacitor. The commutation capacitor is so connected in the circuit that such discharge thereof results in the application of a reverse-bias voltage across the main electrodes of the first electronic switch. The application of such reverse-bias voltage initiates the termination of current flow through the flash tube.

Light-integrator-controlled electronic flash units are designed in such a way that the flash tube of the unit gives off only as much light as is necessary for the proper illumination of the subject. To this end, use is made of a circuit arrangement which senses ambient light and, when the total amount of ambient light sensed over a period of time has reached a predetermined threshold value, interrupts the flow of current to the flash tube. For example, if light is given off by the flash tube of the flash unit, such light will in general fall upon objects located not far from the flash unit. A part of such light will accordingly be reflected back towards the flash unit and effect the activation of the light-sensing and integrating means, after the total amount of thusly sensed light has exceeded a certain value. The activation of the light-sensing and integrating means results in the interruption of current flow to the flash lamp, and the latter is thereby extinguished.

U.S. Pat. No. 3,857,064 discloses a circuit arrangement for controlling the operation of a load element which converts the electric current from an energy source into a flash of light. Means are provided for detecting the light from this load element and generating a signal when a certain total amount of light has been produced. This circuit arrangement includes a first electronic switch having two main electrodes, the switch being connected by means of its two main electrodes in series with the load elwement and an energy source. The electronic switch additionally includes a control electrode. The application of a signal to the control electrode renders the first electronic switch conductive, and the switch causes electrical energy to be furnished to the load element so that the latter may produce the flash of light.

This known circuit arrangement further includes a gas-filled tube which serves as a switch. The tube is comprised of closely spaced main electrodes and a firing electrode. One of the main electrodes of this gas-filled tube is connected with one of the main electrodes of the first electronic switch. A commutation capacitor connects the other main electrode of the gas-filled tube to the junction between the first electronic switch and the load element.

A disadvantage of the configuration of this circuit arrangement involves the fact that the gas-filled tube must be provided with a separate control electrode for effecting tube firing.

SUMMARY OF THE INVENTION

It is a general object of the invention to provide an improved circuit configuration for the flash unit circuit in which the second electronic switch is an element, preferably a gas-filled discharge tube which does not require the use of such a control electrode.

This object can be achieved by using as the second electronic switch a two-electrode switch element, preferably a gas-filled tube which is comprised of only two electrodes and is filled with a gas of such a character and maintained under such a pressure that the main phase of its discharge occurs essentially in the high-current arc mode, with the discharge of this tube being effected by a circuit arrangement which superimposes a supplemental voltage upon the voltage normally applied across the electrodes of the tube, these two voltages when superimposed exceeding the discharge voltage of the tube.

One of the main advantages of the inventive circuit expedient resides in the fact that when the second switch has the form of such a gas-filled tube (or other two-electrode switch element) the firing of the tube is effected not via the control electrode of the tube, but instead by superimposing a supplemental voltage upon the voltage across the main electrodes of the tube. If the sum of such superimposed voltages exceeds the discharge voltage of the tube, the tube fires. Likewise, if the discharge voltage is not reached, the tube remains non-conductive.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
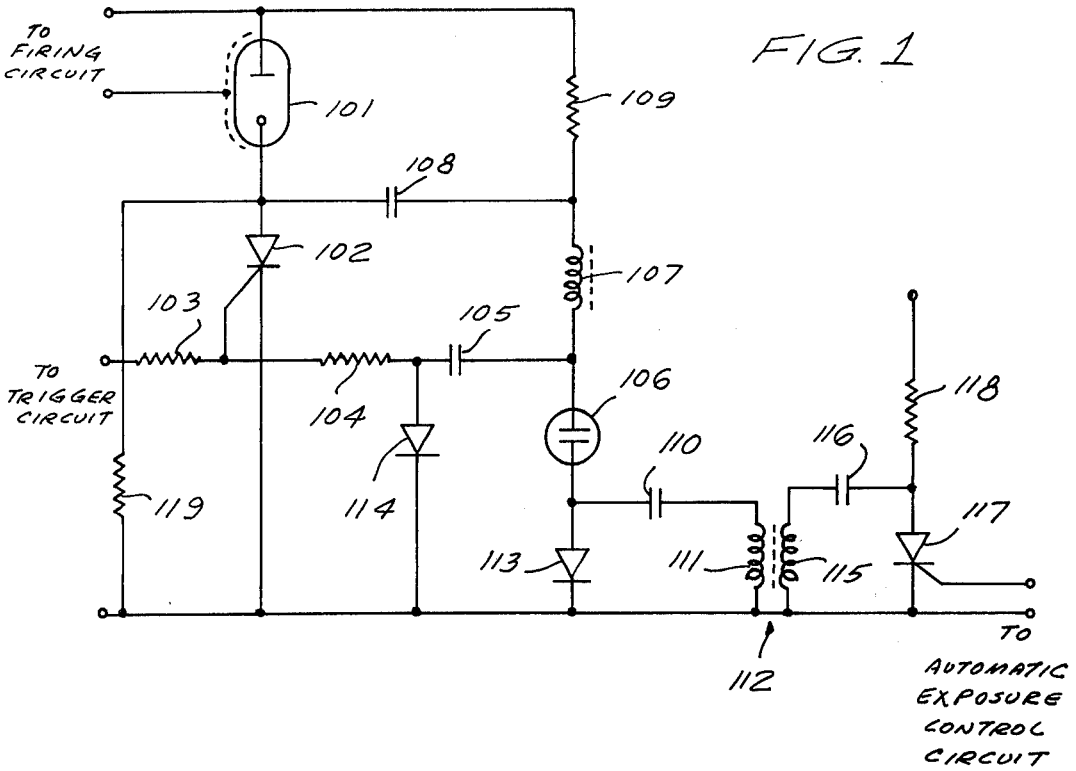
FIG. 1 depicts a circuit arrangement in which a supplemental voltage is applied to the tube serving as the second electronic switch.

The flash tube in FIG. 1 is denoted by numeral 101. Its anode is connected to a (non-illustrated) ignition capacitor. Its firing electrode is connected to a (non-illustrated) ignition transformer. Its cathode is connected to the anode of a thyristor 102 here constituting the first electronic switch. The non-illustrated circuit components are known per se and need not be described in detail; details may be had, for example, from U.S. Pat. No. 3,833,834. The control electrode of thyristor 102 is connected, on the one hand, via a first resistor 103 to the (non-illustrated) firing capacitor and, on the other hand, via a second resistor 104 and a capacitor 105 to one main electrode of the tube 106, here constituting the second electronic switch. This same main electrode of tube 106 is connected to the anode of first electronic switch 102 through the intermediary of a choke 107 and a commutation capacitor 108. Additionally, this main electrode is connected with the anode of flash tube 101 via the choke 107 and a resistor 109.

The other main electrode of tube 106 is connected via a capacitor 110 to the secondary winding 111 of a transformer 112 and is additionally connected via a diode 113 to the cathode of thyristor 102, the anode of the diode 113 being connected to tube 106. Connected intermediate the cathode of diode 113 and the capacitor 105 is a further diode 114 whose anode is connected to the one of the electrodes of capacitor 105 not connected to tube 106.

The primary winding 115 of transformer 112 is connected via a capacitor 116 and the anode-cathode path of a thyristor 117 to the other terminals of secondary and primary windings 111, 115 of transformer 112. The control electrode of thyristor 117 is connected to a (non-illustrated) automatic exposure control circuit operative for detectng the light emitted by the flash unit toward the object to be illuminated and reflected by such object back toward the flash unit. The automatic exposure control circuit is per se conventional and applies a forward-bias voltage to the control electrode of thyristor 117 when the total amount of thusly reflected light sensed by the exposure control circuit reaches a predetermined value. Such automatic exposure control circuits are extremely well known; several are disclosed in U.S. Pat. No. 3,857,064, cf. for example FIG. 1, components 104, 105. The cathode of tube 101 is connected via a resistor 119 to the cathodes of thyristor 102 and diodes 113 and 114, as well as to one terminal of secondary winding 111.

The circuit arrangement depicted in FIG. 1 operates as follows:

Prior to initiation of the flash, the commutation capacitor 108 charges up through resistors 109 and 119, as does also the (non-illustrated) ignition capacitor. The capacitor 105 too charges up, via the choke 107 and the diode 114. When a triggering pulse is applied to the control electrode of thyristor 102, thyristor 102 becomes conductive. The triggering pulse is generated by a (non-illustrated) trigger circuit upon the activation of the camera flash contact and is applied to the control electrode of thyristor 102 through the intermediary of resistor 103. When thyristor 102 becomes conductive, and causes a high current to flow through the flash lamp 101, the plasma of which has already been ionized by means of an external firing electrode, so that light will be given off by the flash lamp 101. The emitted light is reflected back from the object being illuminated and is detected by the light sensor of the (non-illustrated) automatic exposure control circuit. When the total amount of thusly reflected and sensed light has reached a certain value, a signal is applied to the control electrode of thyristor 117, causing thyristor 117 to become conductive. As a result, capacitor 116, which has previously charged up, discharges through the primary winding 115 of transformer 112. The voltage surge generated in this way in the secondary winding 111 of transformer 112 is superimposed via capacitor 110 as a supplemental voltage upon the voltage already applied to the tube 106.

The sum of the voltages now applied across the electrodes of tube 106 is now greater than the discharge voltage of the tube, so that tube 106 fires. As a result, current flows from capacitor 108, through choke 107, tube 106, diode 113 and thyristor 102. The current flowing through tube 106 to the cathode of thyristor 102 renders thyristor 102 non-conductive. The transition of thyristor 102 into its non-conductive state occurs very quickly, because capacitor 105 applies a reverse-bias voltage to the gate-cathode path of the thyristor and furthermore discharges through such gate-cathode path, feeding reverse current into the thyristor gate. Thus, the capacitor 105 acts as an auxiliary commutation capacitor.

Diode 113 must be connected with a polarity such that the supplemental voltage surge developed across the secondary winding 111 of transformer 112 is not short-circuited out by diode 113 but instead is additively superimposed upon the voltage applied to tube 106 by capacitor 108.

The choke 107 of FIG. 1 serves to limit the current which flows from capacitor 108 through the thyristor 102, to prevent destruction of the thyristor 102.

Figure 2:
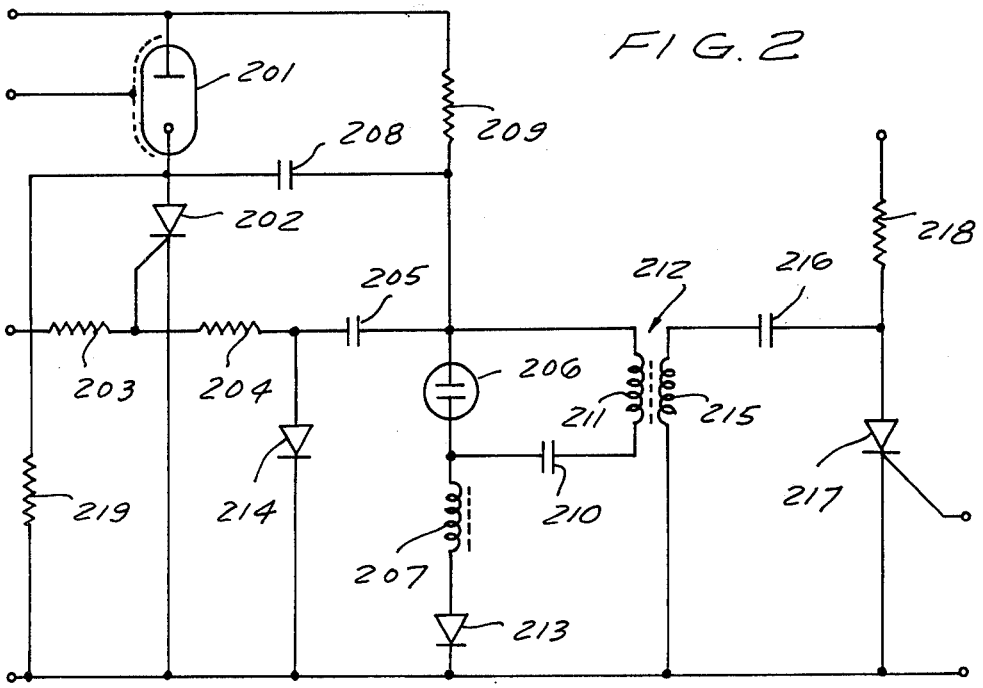
FIG. 2 depicts a circuit arrangement in which a supplemental voltage is applied in parallel to the two electrodes of the tube.

FIG. 2 depicts a circuit arrangement in which the supplemental voltage is not added to the normally present tube voltage by boosting the potential at one of the main electrodes of the tube, but instead by directly superimposing the supplemental voltage upon the voltage normally present on the tube electrodes. To this end, the secondary winding 211 of transformer 212 is directly connected to one electrode of tube 206 and connected to the other electrode of tube 206 through the intermediary of a capacitor 210. In contrast to the circuit arrangement of FIG. 1, the choke 207 is not connected between the first main electrode of tube 206 and the commutation capacitor 208, but instead is connected between the second main electrode of tube 206 and the diode 213.

When thyristor 217 is fired, a voltage surge will again develop across the secondary winding 211 of transformer 212. This voltage surge will be added to the voltage already applied to the electrodes of tube 206 by capacitor 208. The sum of these two voltages exceeds the discharge voltage of tube 206, so that the latter fires.

The commutation action described above, serving to render thyristor 102 non-conductive in FIG. 1, has the same effect upon thyristor 202 in FIG. 2.

Because of the connection of choke 207 beneath (as viewed in FIG. 2) the tube 206, not only the discharge current of capacitor 208, but also the discharge current of auxiliary commutation capacitor 205, will have their amplitude peaks flattened.

Figure 3:
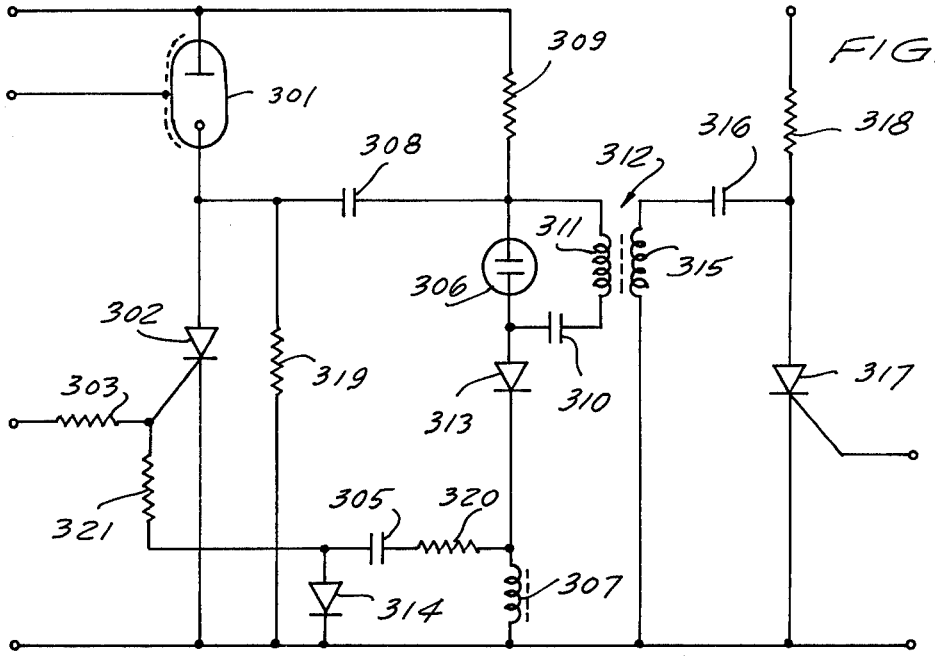
FIG. 3 depicts a circuit arrangement in which a supplemental voltage is applied parallel to the two electrodes of the tube and in which a diode is connected at its anode to one electrode of the tube.

FIG. 3 depicts a further embodiment. Here, the supplemental voltage is superimposed upon the normal tube voltage in a way similar to that in FIG. 2. However, in contrast to FIG. 2, the tube 306 is connected intermediate the two commutation capacitors 308 and 305. Auxiliary commutation capacitor 305 accordingly does not charge simultaneously with commutation capacitor 308, but instead initially remains uncharged. Not until the commutation operation — i.e., when capacitor 308 discharges — does capacitor 305 charge up through resistor 320 and diode 314 and apply a reverse-bias voltage to the gate-cathode path of thyristor 302, through the intermediary of resistor 321.

Figure 4:
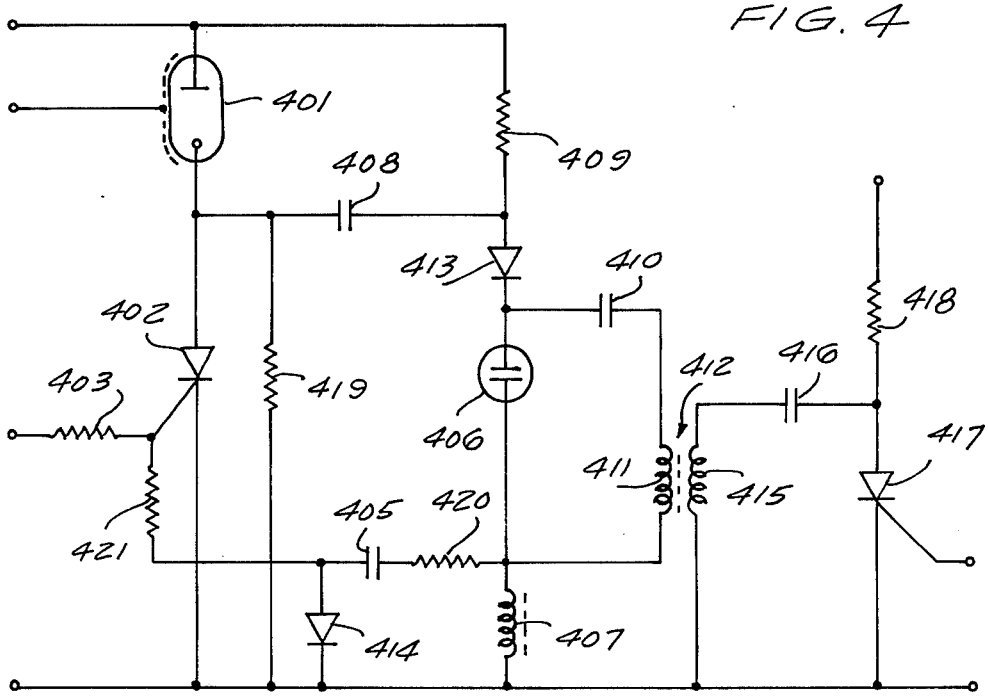
FIG. 4 depicts a circuit arrangement in which a supplemental voltage is applied parallel to the two electrodes of the tube and in which a diode is connected at its cathode to one electrode of the tube.

FIG. 4 depicts an embodiment which differs from that of FIG. 3 in that the diode 413 is connected not below tube 416 but instead above it (as viewed in FIGS. 3 and 4). This change of connection has been found to be of advantage in certain circuits.

Figure 5:
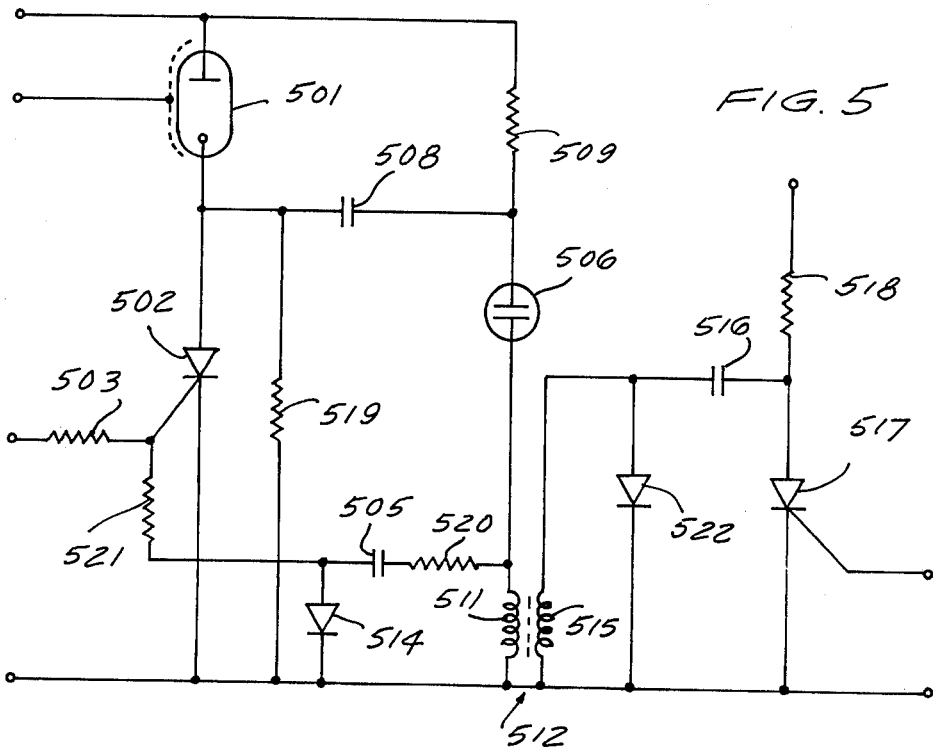
FIG. 5 depicts a circuit arrangement in which a supplemental voltage is applied to the tube and in which the secondary winding of a transformer is connected in series with the tube, the secondary winding serving as a current-limiting choke.

FIG. 5 depicts a circuit arrangement which does not make use of a separate choke, but in which instead the secondary winding 511 of transformer 512 assumes the function of the omitted choke. Also, a diode 522 is connected in parallel to the primary winding 515 of transformer 512. Diode 522 prevents oscillation of the oscillatory circuit comprised of the primary winding 511 of transformer 512 and the capacitor 516. As with the embodiment of FIG. 3, auxiliary commutation capacitor 505 does not begin to charge up until the start of the commutation operation.

Upon the firing of tube 506, the secondary winding 511 of transformer 512 decreases the rate at which current rises in the tube current path, and the voltage surge induced in the secondary winding 511 is applied, via resistor 520 and capacitor 505, as a negative gate voltage to the control electrode of thyristor 502, improving its turn-off behavior.

Figure 6:
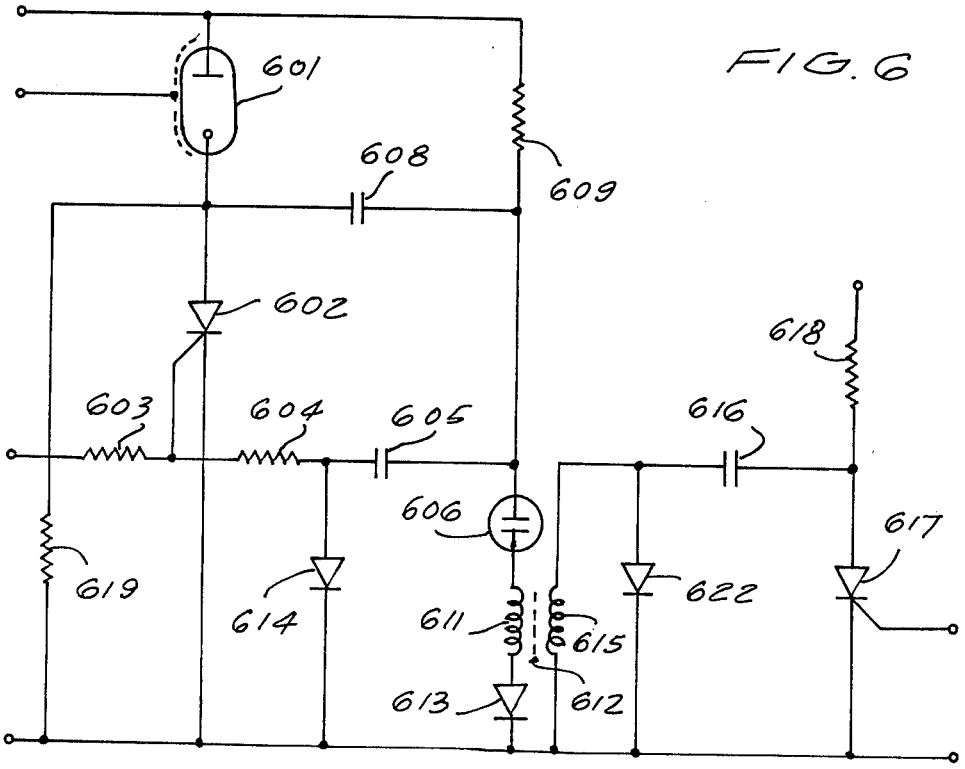
FIG. 6 depicts a circuit arrangement in which a supplemental voltage is applied to the tube and in which a diode and also the secondary winding of a transformer are connected in series with the tube.

FIG. 6, finally, depicts a circuit arrangement in which the secondary winding 611 of transformer 612 and also a diode 613 are connected in series with the tube 606. As in the embodiment of FIG. 5, this connection makes unnecessary the use of a separate choke. In other respects, the embodiment of FIG. 6 corresponds to those of FIGS. 1 and 2; i.e., the two commutation capacitors 608, 605 discharge during the commutation operation.

The use of a two-electrode gas-filled discharge tube rendered conductive to carry current in its high-current arc-discharge mode is particularly advantageous, but not the only expedient contemplated by the invention. The invention contemplates additionally the use of other two-electrode electronic switch elements, including three- or multi-electrode electronic switch devices, but with only two of the electrodes receiving the control signals for rendering the second electronic switch conductive. For example a silicon controlled rectifier, silicon controlled switch or thyristor could be used in a two-electrode-triggered mode in which no control voltages need be applied to the additional electrodes to render the switch conductive. For example, in the case of a silicon controlled switch, the additional electrodes could be left entirely unconnected to other circuit components, so that the multi-electrode switch would constitute a two-electrode switch in the context of the circuit in which it is connected.

It will be understood that each of the elements described above, or two or more together, may also find a useful application in other types of circuits differing from the types described above.

While the invention has been illustrated and described as embodied in light-integrator-controlled circuits for electronic flash units, it is not intended to be imited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In an electronic flash unit, in combination, a flash element; a first electronic switch connected in the current path of the flash element; means for igniting the flash element by rendering the first electronic switch conductive; and means for terminating the flash by rendering the first electronic switch non-conductive, including a commutation capacitor and a second electronic switch interconnected with each other and with the first electronic switch for applying the commutation capacitor voltage to the first electronic switch as a reverse-bias voltage when the second electronic switch is rendered conductive, the second electronic switch having two electrodes defining therebetween the current path of the second electronic switch, the conductivity of the current path of the second electronic switch being controlled by controlling the voltage across the two electrodes of the second electronic switch, and light-integrating means operative for detecting the amount of light emitted by the flash element and when such amount has reached a predetermined value rendering the current path between the two electrodes of the second electronic switch conductive by raising the voltage across the two electrodes of the second electronic switch.

2. The electronic flash unit defined in claim 1, the second electronic switch having only two electrodes.

3. The electronic flash unit defined in claim 1, the conductivity of the second electronic switch being determined exclusively by the voltage applied across the two electrodes.

4. The electronic flash unit defined in claim 3, the second electronic switch having only two electrodes.

5. The electronic flash unit defined in claim 1, the second electronic switch being a gas discharge tube, the light-integrating means comprising means for rendering the gas discharge tube conductive by applying across the electrodes of the gas discharge tube a voltage high enough to cause the establishment of arc discharge current flow through the tube.

6. The electronic flash unit defined in claim 5, the second electronic switch being a gas discharge tube having only two electrodes.

7. The electronic flash unit defined in claim 1, the first electronic switch having two main electrodes defining a main current path connected in the current path of the flash element, the first electronic switch additionally having a control electrode, the commutation capacitor being connected between one main electrode of the first electronic switch and one electrode of the second electronic switch, the means for terminating additionally including a further commutation capacitor connected between the control electrode of the first electronic switch and the aforementioned one electrode of the second electronic switch.

8. The electronic flash unit defined in claim 7, the means for terminating further including a resistor, the aforementioned one electrode of the second electronic switch being connected to the aforementioned control electrode of the first electronic switch through the intermediary of both the further commutation capacitor and the resistor.

9. The electronic flash unit defined in claim 1, the first electronic switch having two main electrodes and a control electrode, further including an inductor, the commutation capacitor being connected between one main electrode of the first switch and one terminal of the inductor, the other terminal of the inductor being connected to one electrode of the second switch for limiting the current flowing through the second switch.

10. The electronic flash unit defined in claim 1, the means for terminating further including a transformer having a primary winding and a secondary winding, a third electronic switch and a discharge capacitor, the primary winding forming together with the discharge capacitor and the third electronic switch a circuit mesh, and means for rendering the third electronic switch conductive when the light amount has reached the predetermined value to discharge the discharge capacitor through the primary winding and thereby induce a voltage surge across the secondary winding, the secondary winding being connected to one electrode of the second electronic switch so that the voltage surge is transmitted thereto and in that way raises the voltage across the two electrodes of the second electronic switch.

11. The electronic flash unit defined in claim 1, the means for terminating further including a diode connected in the current path of the second switch and an inductance connected intermediate the diode and the second switch.

12. The electronic flash unit defined in claim 1, the means for terminating further including a transformer having a primary winding and a secondary winding, a third electronic switch and a discharge capacitor, the primary winding forming together with the discharge capacitor and the third electronic switch a circuit mesh, and means for rendering the third electronic switch conductive when the light amount has reached the predetermined value to discharge the discharge capacitor through the primary winding and thereby induce a voltage surge across the secondary winding, and a further capacitor connected in series with the secondary winding, the series connection of the further capacitor and the secondary winding being connected in parallel with the second electronic switch.

13. The electronic flash unit defined in claim 1, the first switch having two main electrodes and a control electrode, the means for terminating further including an inductance connected in the current path of the second switch, a diode connected in the current path of the second switch intermediate the latter and the inductance, a further diode having one terminal connected to one terminal of the inductance, a further commutation capacitor and a resistor connecting the other terminal of the further diode to the other terminal of the inductance, a further resistor connecting the other terminal of the further diode to the control electrode of the first switch.

14. The electronic flash unit defined in claim 1, the first switch having two main electrodes and a control electrode, the means for terminating further including a diode and an inductance connected in the current path of the second switch, the second switch being connected intermediate the diode and inductance, the commutation capacitor being connected between one terminal of the flash element and the terminal of the diode not connected to the second switch, a further diode having one terminal connected to one terminal of the inductance, a resistor and a further commutation capacitor being connected between the other terminal of the further diode and the other terminal of the inductance, a further resistor connected between the aforementioned other terminal of the further diode and the control electrode of the first switch.

15. The electronic flash unit defined in claim 1, the flash element being a flash lamp having two main electrodes and a firing electrode, the means for terminating further including a transformer having a primary winding and a secondary winding, a discharge capacitor, a third electronic switch and a diode, the commutation capacitor connecting one electrode of the second switch to one main electrode of the flash lamp, the secondary winding being connected to the electrode of the second switch not connected to the commutation capacitor, the diode being connected in parallel to the primary winding, the discharge capacitor and third switch being connected across the primary winding.

16. The electronic flash unit defined in claim 15, the means for terminating further including a further diode having one terminal connected to the terminal of the secondary winding not connected to the second switch, a further commutation capacitor and a resistor connecting the other terminal of the further diode to the terminal of the secondary winding connected to the second switch, a further resistor connecting the aforementioned other terminal of the further diode to the control electrode of the first switch.

17. The electronic flash unit defined in claim 1, the flash element being a flash lamp having two main electrodes and a firing electrode, the commutation capacitor connecting one terminal of the second switch to one main electrode of the flash lamp, the means for terminating further including a transformer having a primary winding and a secondary winding, a diode, a discharge capacitor and a third electronic switch, the secondary winding being connected in the current path of the second switch and connected to the terminal of the second switch not connected to the commutation capacitor, the diode being connected in parallel with the primary winding, the discharge capacitor and the third switch being connected across the primary winding.

18. The electronic flash unit defined in claim 17, the terminating means further including a diode connected in the current path of the second switch between one terminal of the secondary winding and one terminal of the primary winding.

19. The electronic flash unit defined in claim 1, the first electronic switch having two main electrodes defining a main current path connected in the current path of the flash element, the first electronic switch additionally having a control electrode, the means for terminating further including a first diode and a second diode, the anode of the first diode being connected to one electrode of the second electronic switch and the cathode of the first diode being connected to one main electrode of the first electronic switch, the cathode of the first diode being connected to the cathode of the second diode, the means for terminating including a further commutation capacitor connected between the anode of the second diode and the other electrode of the second semiconductor switch and a resistor connecting the anode of the second diode to the control electrode of the first semiconductor switch.

20. In an electronic flash unit, in combination, a flash element; a first electronic switch connected in the current path of the flash element; means for igniting the flash element by rendering the first electronic switch conductive; and means for terminating the flash by rendering the first electronic switch non-conductive, including a commutation capacitor and a second electronic switch interconnected with each other and with the first electronic switch for applying the commutation capacitor voltage to the first electronic switch as a reverse-bias voltage when the second electronic switch is rendered conductive, the second electronic switch being a two-electrode electronic switch which can be rendered conductive by raising the voltage across its electrodes, and light-integrating means operative for detecting light emitted by the flash element and when such amount has reached a predetermined value rendering the second electronic switch conductive by raising the voltage across the electrodes of the second electronic switch, the first electronic switch having two main electrodes defining a main current path connected in the current path of the flash element, the first electronic switch additionally having a control electrode, the commutation capacitor being connected between one main electrode of the first electronic switch and one electrode of the second electronic switch, the means for terminating additionally including a further commutation capacitor connected between the control electrode of the first electronic switch and the aforementioned one electrode of the second electronic switch.

21. The electronic flash unit defined in claim 20, the means for terminating further including a resistor, the aforementioned one electrode of the second electronic switch being connected to the aforementioned control electrode of the first electronic switch through the intermediary of both the further commutation capacitor and the resistor.

22. In an electronic flash unit, in combination, a flash element; a first electronic switch connected in the current path of the flash element; means for igniting the flash element by rendering the first electronic switch conductive; and means for terminating the flash by rendering the first electronic switch non-conductive, including a commutation capacitor and a second electronic switch interconnected with each other and with the first electronic switch for applying the commutation capacitor voltage to the first electronic switch as a reverse-bias voltage when the second electronic switch is rendered conductive, the second electronic switch being a two-electrode electronic switch which can be rendered conductive by raising the voltage across its electrodes, and light-integrating means operative for detecting light emitted by the flash element and when such amount has reached a predetermined value rendering the second electronic switch conductive by raising the voltage across the electrodes of the second electronic switch, the first switch having two main electrodes and a control electrode, the means for terminating further including an inductance connected in the current path of the second switch, a diode connected in the current path of the second switch intermediate the latter and the inductance, a further diode having one terminal connected to one terminal of the inductance, a further commutation capacitor and a resistor connecting the other terminal of the further diode to the other terminal of the inductance, a further diode to the other terminal of the inductance, a further resistor connecting the other terminal of the further diode to the control electrode of the first switch.

23. In an electronic flash unit, in combination, a flash element; a first electronic switch connected in the current path of the flash element; means for igniting the flash element by rendering the first electronic switch conductive; and means for terminating the flash by rendering the first electronic switch non-conductive, including a commutation capacitor and a second electronic switch interconnected with each other and with the first electronic switch for applying the commutation capacitor voltage to the first electronic switch as a reverse-bias voltage when the second electronic switch is rendered conductive, the second electronic switch being a two-electrode electronic switch which can be rendered conductive by raising the voltage across its electrodes, and light-integrating means operative for detecting light and emitted by the flash element and when such amount has reached a predetermined value rendering the second electronic switch conductive by raising the voltage across the electrodes of the second electronic switch, the first switch having two main electrodes and a control electrode, the means for terminating further including a diode and an inductance connected in the current path of the second switch, the second switch being connected intermediate the diode and inductance, the commutation capacitor being connected between one terminal of the flash element and the terminal of the diode not connected to the second switch, a further diode having one terminal connected to one terminal of the inductance, a resistor and a further commutation capacitor being connected between the other terminal of the further diode and the other terminal of the inductance, a further resistor connected between the aforementioned other terminal of the further diode and the control electrode of the first switch.

24. In an electronic flash unit, in combination, a flash element; a first electronic switch connected in the current path of the flash element; means for igniting the flash element by rendering the first electronic switch conductive; and means for terminating the flash by rendering the first electronic switch non-conductive, including a commutation capacitor and a second electronic switch interconnected with each other and with the first electronic switch for applying the commutation capacitor voltage to the first electronic switch as a reverse-bias voltage when the second electronic switch is rendered conductive, the second electronic switch being a two-electrode electronic switch which can be rendered conductive by raising the voltage across its electrodes, and light-integrating means operative for detecting light emitted by the flash element and when such amount has reached a predetermined value rendering the second electronic switch conductive by raising the voltage across te electrodes of the second electronic switch, the flash element being a flash lamp having two main electrodes and a firing electrode, the means for terminating further including a transformer having a primary winding and a secondary winding, a discharge capacitor, a third electronic switch and a diode, the commutation capacitor connecting one electrode of the second switch to one main electrode of the flash lamp, the secondary winding being connected to the electrode of the second switch not connected to the commutation capacitor, the diode being connected in parallel to the primary winding, the discharge capacitor and third switch being connected across the primary winding, the means for terminating further including a further diode having one terminal connected to the terminal of the secondary winding not connected to the second switch, a further commutation capacitor and a resistor connecting the other terminal of the further diode to the terminal of the secondary winding connected to the second switch, a further resistor connecting the aforementioned other terminal of the further diode to the control electrode of the first switch.

25. In an electronic flash unit, in combination, a flash element; a first electronic switch connected in the current path of the flash element; means for igniting the flash element by rendering the first electronic switch conductive; and means for terminating the flash by rendering the first electonic switch non-conductive, including a commutation capacitor and a second electronic switch interconnected with each other and with the first electronic switch for applying the commutation capacitor voltage to the first electronic switch as a reverse-bias voltage when the second electronic switch is rendered conductive, the second electronic switch being a two-electrode electronic switch which can be rendered conductive by raising the voltage across its electrodes, and light-integrating means operative for detecting light emitted by the flash element and when such amount has reached a predetermined value rendering the second electronic switch conductive by raising the voltage across the electrodes of the second electronic switch, the first electronic switch having two main electrodes defining a main current path connected in the current path of the flash element, the first electronic switch additionally having a control electrode, the means for terminating further including a first diode and a second diode, the anode of the first diode being connected to one electrode of the second electronic switch and the cathode of the first diode being connected to one main electrode of the first electronic switch, the cathode of the first diode being connected to the cathode of the second diode, the means for terminating including a further commutation capacitor connected between the anode of the second diode and the other electrode of the second semiconductor switch and a resistor connecting the anode of the second diode to the control electrode of the first semiconductor switch.

* * * * *